US009127914B2

(12) United States Patent
Millar

(10) Patent No.: US 9,127,914 B2
(45) Date of Patent: Sep. 8, 2015

(54) MINE RESISTANT COMBAT BOOT, BLAST MITIGATING

(71) Applicant: David J. Millar, St. Charles, MO (US)

(72) Inventor: David J. Millar, St. Charles, MO (US)

( * ) Notice: Subject to any disclaimer, the term of this patent is extended or adjusted under 35 U.S.C. 154(b) by 27 days.

(21) Appl. No.: 13/918,420

(22) Filed: Jun. 14, 2013

(65) Prior Publication Data

US 2014/0150293 A1 Jun. 5, 2014

Related U.S. Application Data

(63) Continuation-in-part of application No. 13/907,434, filed on May 31, 2013, now Pat. No. 8,857,895, which is a continuation-in-part of application No. 13/523,972, filed on Jun. 15, 2012.

(60) Provisional application No. 61/660,706, filed on Jun. 16, 2012, provisional application No. 61/654,853, filed on Jun. 2, 2012, provisional application No. 61/498,300, filed on Jun. 17, 2011.

(51) Int. Cl.

| | |
|---|---|
| ***A43B 13/12*** | (2006.01) |
| ***F41H 1/00*** | (2006.01) |
| ***A43B 13/14*** | (2006.01) |
| ***A43B 13/02*** | (2006.01) |
| ***A43B 3/00*** | (2006.01) |
| ***A43B 7/32*** | (2006.01) |

(52) U.S. Cl.

CPC ..... *F41H 1/00* (2013.01); *A43B 3/0026* (2013.01); *A43B 7/32* (2013.01); *A43B 13/026* (2013.01); *A43B 13/127* (2013.01); *A43B 13/141* (2013.01)

(58) Field of Classification Search

CPC .. A43B 3/0026; A43B 13/127; A43B 13/141; A43B 13/026

USPC ..... 36/113, 30 R, 103, 72 B

See application file for complete search history.

(56) References Cited

U.S. PATENT DOCUMENTS

| | | | | |
|---|---|---|---|---|
| 3,318,024 | A * | 5/1967 | Fujinaka et al. | 36/85 |
| 3,516,181 | A * | 6/1970 | Jordan | 36/7.5 |
| 6,655,051 | B1 * | 12/2003 | Peche et al. | 36/103 |
| 8,047,117 | B1 * | 11/2011 | Tan | 89/36.05 |
| 2009/0090024 | A1 * | 4/2009 | Phlawadana et al. | 36/1.5 |

FOREIGN PATENT DOCUMENTS

WO WO 0132042 A1 * 5/2001

* cited by examiner

*Primary Examiner* — Ted Kavanaugh

(74) *Attorney, Agent, or Firm* — Charles McCluskey

(57) ABSTRACT

A blast deflecting boot has a V like shaped sole, a layer to reduce and to stop high velocity fragments, a padded core that limits the blast forces transmitted to the lower leg of a soldier, and an upper of high velocity blast fragment reducing fabric. The invention provides the sole within a layer of non-slip urethane that contains energy absorbing foam, a layer of high velocity fragment reducing para-aramid or ultra-high molecular weight polyethylene UHMWPE fabric, and a core of closed cell single or multiple density high energy absorbing foam or silicone that absorbs impact forces. The insole has a high velocity fragment reducing layer system of multiple layers of UHMWPE, or para-aramid. The sole of the present invention may have a unitary form or be assembled from multiple sections.

1 Claim, 2 Drawing Sheets

MINE RESISTANT COMBAT BOOT, BLAST MITIGATING

CROSS-REFERENCE TO RELATED APPLICATION

This non-provisional application claims priority to the provisional application 61/660,706 filed on Jun. 16, 2012 and is a continuation in part of the non-provisional application Ser. No. 13/907,434 filed on May 31, 2013 which claims priority to the provisional application 61/654,853 filed on Jun. 2, 2012 and which is a continuation in part of the non-provisional application Ser. No. 13/523,972 filed on Jun. 15, 2012 which claims priority to the provisional application 61/498,300 filed on Jun. 17, 2011, all of which are owned by the same inventor.

BACKGROUND OF THE INVENTION

The blast mitigating boot relates generally to reduction and prevention of injuries inflicted upon persons, such as ground personnel, from improvised explosive device, or "IED," and anti-personnel mine blast events, and more specifically to the reduction of tibia, fibula, foot, and ankle injuries. A person, military or civilian, can readily wear the invention as it fits within typical boot designs for military or heavy industry applications. A person with little or no comprehension of English can also utilize the invention.

From before the Revolutionary War, the military developed mines and used explosives. Mines began as containers of gunpowder concealed upon a battlefield and triggered by release of various mechanical actuators like trip wires. Military explosives started as full gunpowder containers triggered with fuses or rifle rounds. From those beginnings in this country mines and military explosives have evolved, proliferated, and developed in other countries. Present day mines serve two purposes: anti-tank and anti-personnel, abbreviated as AT mines and AP mines respectively. AT mines may include warheads so that the AT mine can disable an armored vehicle. AP mines generally have less explosive than AT mines. AP mines generally remain small in size, readily carried, quickly concealed, and designed to maim the limbs of a soldier. Such limbs include the leg with its femur bone in the upper leg and the fibula and tibia bones in the lower leg. AP mines come in various shapes and sizes ranging from toe-poppers up to leg severing devices.

In the last decade, military action in Iraq and Afghanistan has seen the rise of improvised explosive devices, or IED. These devices generally have a home made construction of explosives and placement in atypical locations such as in walls three feet above the ground, in peasant carts, on persons, in cargo, and the like. IED have posed an asymmetric threat to US and allied forces and civilians in the Iraqi and Afghani theatres of operations.

To mitigate the IED threat, military forces have increased their force protection efforts. These efforts have placed more personal armor upon ground personnel, or soldiers, even for routine tasks, such as mail delivery, than in prior military conflicts. The armor includes various vests such as flak vest and bulletproof vest, leggings, shin guards, and chest plates to name a view. Widening of deployment for the Explosive Ordnance Disposal, or EOD, blast suit has also occurred to additional personnel. The efforts have also adjusted tactics and procedures for movement of combat and non-combat soldiers across terrain, in rural areas, and in urban areas. However, the enemy has recognized this and adapted the IED to more potent models and placement beneath soldiers' feet. The US has also responded with greater usage of EOD blast suits, wider usage of steel toe boots and steel shank boots among other things. Usage of steel in boots though remains limited by magnetically activated mines and the needs of soldiers to run and to bend while wearing the boots. A full metal boot sole has not yet seen wide deployment in the military.

Though this application mentions military and soldier, the Applicant utilizes those terms in a broad sense to represent all military services, their personnel, and to include select heavy civilian applications such as mining and quarrying that involve blasting.

DESCRIPTION OF THE PRIOR ART

Traditionally, manufacturers have provided footwear to military specifications. The footwear, typically boots, for rugged field use has a laced upper upon a sole with oil resistant cleats. The upper fits snugly upon the lower calf, ankle, and foot of the soldier. For many years, the upper was black leather however, recent engagements in Southwest Asia have stimulated use of pale or even tan colored canvas uppers and soles. The boots come in a range of sizes and widths to fit the various feet of soldiers. The boots have a design suitable for foot protection from abrasion and some comfort for long periods of wearing such as forced marches. Currently, most combat boots provide limited protection from blast events that result in high foot, ankle, fibula, and tibia loads. These high loads break bones and inflict soft tissue injuries upon soldiers during blast events from mines buried in the earth to placement low in nearby walls or structures. These injuries debilitate one soldier so that one or more other soldiers must assist the injured soldier, tying up manpower and causing commanders to redirect resources away from combat.

As mentioned above, select boots have steel toes and shanks in their soles. The steel toe protects against crushing as a soldier drops a heavy load or has a location near a falling heavy load. However, the steel toe protects the top of the toes not the bottom exposed to blast events. Steel shanks provide a rigid sole and resistance to pungi sticks, nails, and other puncture hazards in the area of operations. However, the steel shank remains narrow and has a limited effect on preventing blast injuries. Also these metal components in a boot have a magnetic signature to a degree. Select mines have magnetic detonators which make usage of steel toes and shanks a rare feature in boots.

The present invention reduces and in some events prevents lower leg injuries to the foot, ankle, fibula, and tibia of soldiers who encounter anti-personnel mines placed in expected or unexpected locations.

SUMMARY OF THE INVENTION

Generally, the present invention provides a blast deflecting sole shape, a layer to reduce and stop high velocity fragments, a padded surface that limits the blast forces transmitted to the tibia, fibula, ankle, and foot during blast events, and an upper of high velocity blast fragment reducing fabric. The invention blends hard and soft ballistic material into a sole with an integral flex section. The invention provides the sole within a layer of non-slip urethane that contains energy absorbing foam, a layer of high velocity fragment reducing fabric para-aramid or ultra-high molecular weight polyethylene, or "UHMWPE," fabric, and a core of closed cell single or multiple density high energy absorbing foam that absorbs impact forces. The sole includes a V shape with a centered keel and a plurality of cleats containing energy absorbing material for disposition on the bottom of the boot. The sole generally has para-aramid reinforced urethane or alternatively UHMWPE, fabric. The insole has a high velocity fragment reducing layer system of multiple layers of UHMWPE or para-aramid. The energy absorbing layers and cleats utilize single or dual density closed cell energy absorbing foam, such as expanded polypropylene, or "EPP," expanded polyethylene, or "EPE," or foamed silicone. The sole has an exterior coating or layer of anti fungal, non slip, polyurethane. The sole also may be cut, molded, extruded, and the like, in various sizes. The sole of the present invention may have a unitary form or be assembled from multiple sections. The upper also protects the ankle, tibia, and fibula using, UHMWPE, para-aramid, ballistic nylon, or additional thickness of leather. The upper has typical closures from laces, zippers, hook and loop fasteners and the like.

This invention reduces the injuries suffered by soldiers as it provides a blast deflecting sole design, a layer to reduce and stop high velocity fragments, and a padded surface that limits blast forces transmitted to the soldier's foot, ankle, fibula, and tibia, and an upper made of high velocity blast fragment reducing fabric. EOD personnel use the boots of the invention however, any soldier may wear the boots of the invention.

The Applicant has considered expanded polyethylene, or EPE, and expanded polypropylene, or EPP, as suitable materials to attenuate impact and withstand the elements and biological decay. During testing, the EPP exhibited difficulties with cost and lack of ability to support adhesion upon its surface. The Applicant has solved the lack of adhesion through this invention. The Applicant has removed the low coefficient of friction skin formed upon the surface of an EPP object during its manufacture. The manufacturing of a sole molds and expands polypropylene beads, or pellets, into a piece. However the surface of the piece develops a skin with a smooth exterior because the beads melt and acquire the surface characteristics of the mold, generally smooth. The present invention has skived the surface of a sole and thus exposed approximately 50% of the crystalline structure of individual cells of polypropylene in the piece. Skiving shaves, or imparts, cuts to the surface of the piece making that exposure of the cells. With this cell exposure, the Applicant found a coating that replaces the skin of a wedge, or core, yet allows for other items to adhere, or bond to, the coating applied upon a wedge or core.

There has thus been outlined, rather broadly, the more important features of the invention in order that the detailed description thereof that follows may be better understood and that the present contribution to the art may be better appreciated. The present invention also includes a core that has increased energy absorption properties over the existing boot soles to reduce the forces transmitted to the lower legs of the soldier and reduce or prevent injuries to them, coating additives for coloration, grip, and microbial resistance, variations in EPP density, and elongation of the coating during an impact event. Additional features of the invention will be described hereinafter and which will form the subject matter of the claims attached.

Numerous objects, features and advantages of the present invention will be readily apparent to those of ordinary skill in the art upon a reading of the following detailed description of the presently preferred, but nonetheless illustrative, embodiment of the present invention when taken in conjunction with the accompanying drawings. Before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, the phraseology and terminology employed herein are for the purpose of description and should not be regarded as limiting.

One object of the present invention is to provide a new and improved blast mitigating boot that deflects blast forces and fragments away from the bottom of a soldier's foot during a blast event.

Another object of the present invention is to provide a blast mitigating boot that decreases impact forces upon a soldier's foot by up to a factor of four from a blast event.

Another object of the present invention is to provide a blast mitigating boot that has a blast deflecting sole, an insole that reduces or stops high velocity fragments, and cushion that absorbs blast energy.

Another object of the present invention is to provide a blast mitigating boot that limits the forces transmitted to the soldier's foot, ankle, fibula, and tibia which then reduces forces transmitted to the soldier's lower leg, and prevents or reduces injuries to the soldier wearing the invention.

Another object is to provide such a blast mitigating boot that can be easily and readily installed by civilians with little to no skill, military personnel of all ranks, and foreign nationals with little if any comprehension of English.

Another object is to provide such a blast mitigating boot that resists degradation from fire, water, chlorine, ultraviolet light, bacteria, microbes, fungi, and saltwater.

Another object is to provide such a blast mitigating boot that adjusts to the sizes of soldier's feet.

Another object is to provide such a blast mitigating boot that can be easily and efficiently manufactured and marketed to government departments and agencies and select civilian applications.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated a preferred embodiment of the invention.

BRIEF DESCRIPTION OF THE DRAWINGS

In referring to the drawings.

The same reference numerals refer to the same parts throughout the various figures.

DESCRIPTION OF THE PREFERRED EMBODIMENT

The present invention overcomes the prior art limitations by providing a blast mitigating boot that fits upon a soldier's foot. The invention will be better understood from a reading of the following detailed description of the preferred embodiment and alternate embodiments of the invention in conjunction with the figures in which the sizes and distances between various elements does not represent actual sizes or distances between various elements.

Figure 1:
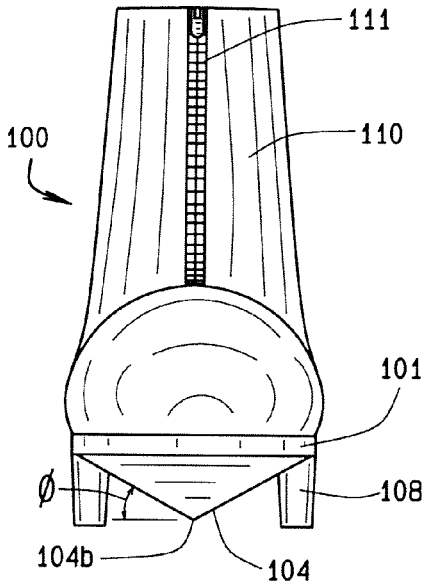
FIG. 1 shows a front view of a boot of the invention.

FIG. 1 provides an end view of the invention of a blast mitigating boot 100. The boot has an upper 110 closed by laces 111 upon a sole 101 that has a V shape, through its thickness, as at 104, and cleats 108 spaced upon the sole. The cleats provide traction in combination with the sole 104. The V shaped sole, as at 104, utilizes a wedge shaped energy absorbing system, or pad system, for use in boot soles that reduces or prevents lower leg injuries from mines and other explosives. The wedge shaped pad system applies to various boots as used throughout the military and heavy industries. The pad system, or core, reduces the blast forces, often accelerations of sole material, which transmit forces resulting injuries into the foot, ankle, tibia, and fibula of a soldier. The invention incorporates readily into military specification boots and allows for ready cleaning of the soles in both garrison and field environments. The invention may see use in military and civilian applications the require impact energy management.

The V shape, as at 104, relies heavily upon the cleats 108, often a plurality of them, to provide traction for the boot. The V shape generally has its vertex, as at 104*b*, slightly above the plane defined by the terminations of the cleats. The vertex is generally opposite the upper and particularly the high velocity fragment reducing layer 103. This spacing slightly above the cleats lessens wear of the V shape so that blast resistance meets specification through the useful life of the boot. This spacing above appears as later shown in FIG. 3.

The sole's V shape has a key property of blast to sole angle, that is, the angle between one half of the V shape and a horizontal plane such as a walking surface or the high velocity fragment reducing layer, of about 20° to about 60° as at ϕ and with a preference of 45°. The blast to sole angle appears in illustration as later shown in FIGS. 3, 4. The invention also has key properties in its cell structure, recovery rates and stiffness, and coating components and processes suitable to blast mitigation.

Figure 2A:
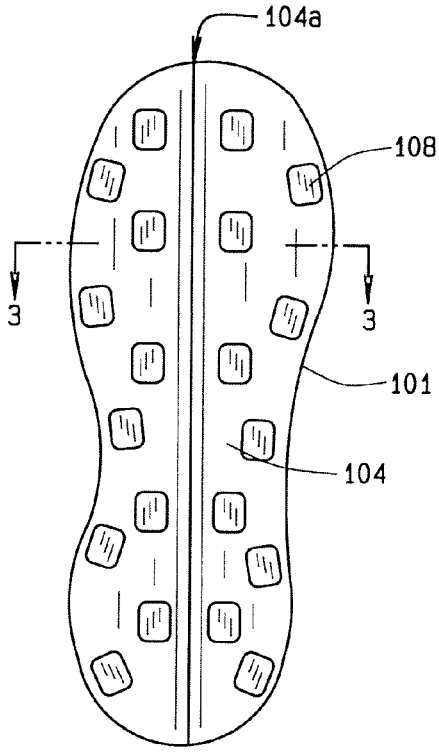
FIG. 2*a* shows a bottom view of the invention.

FIG. 2*a* shows a bottom view of the sole 101 of the invention. The sole has its length, a generally V like shape as at 104 to deflect blast forces and has a plurality of cleats 108 in a pattern common to boot soles. The sole has its keel 104*a* that extends for the length of the sole and denotes the vertex 104*b* of the V like shape, or internal angle. The keel cooperates with the cleats for traction but has a spacing slightly above the cleats to maximize useful life. The sole has a generally urethane construction reinforced with para-aramid and has these key blast force reduction properties: compressive strength from about 2300 psi to about 8000 psi, flexural strength from about 1500 psi to about 5200 psi, flexural modulus of about 100,000 psi to about 950,000 psi, tensile strength of about 1500 psi to about 8000 psi, tensile modulus of about 70,000 psi to about 950,000 psi, and shore A hardness of about 50 to about 90. The assembly of the sole, V like shape as at 104, includes para-aramaid or UHMWPE materials woven together, in a unidirectional manner or in a non directional manner, same or different weights and thicknesses. The sole has vertical layering as later shown in FIGS. 3, 5, and a foam density of about 20 g/I to about 200 g/I. This invention also has cell structure, recovery rates, stiffness, and manufacturing technology suited to it.

Figure 2B:
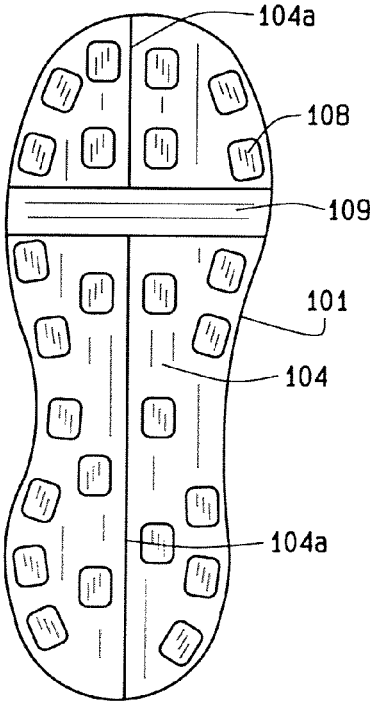
FIG. 2*b* provides a bottom view of an alternate embodiment of the invention.

FIG. 2*b* has an alternate embodiment of the sole. This embodiment also has the V shape 104 with cleats 108 but has a flexure zone 109 proximate the intended location of the ball of the foot of the soldier when wearing the boot. This embodiment has an interruption in the keel 104*a* and in the core 105 which do not span over the flexure zone. The sole merges hard and soft ballistic material so that flexure of the sole occurs in the zone 109 without a portion of the keel and the flexure zone 109 remains integral with the remainder of the sole. The flexure zone 109 has sufficient length, along the direction of the keel, to permit the desired flexing of the sole, as when a soldier is running, while maintaining the greatest extent of blast resistance. The flexure zone has the cushioning layer and the high velocity fragment reducing laminated layer but not the keel and core so that the sole may bend at the flexure layer. Typically, the flexure zone has a length less than that of two cleats.

Figure 3:
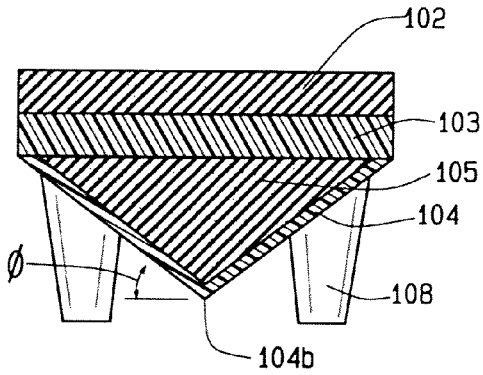
FIG. 3 describes a sectional view of the invention.

Turning more closely to the construction of the sole, FIG. 3 has a sectional view through the invention. The boot sole 101 has an energy absorbing foam layer or cushioning layer, as at 102, incorporated into the sole and opposite the vertex, a high velocity fragment reducing laminated layer, as at 103, beneath the cushioning layer, a blast deflecting V shape or wedge like sole, at 104, and another energy absorbing layer or core as at 105. The layer 103 is generally planar and extends for the length and width of the sole. The layer has construction of high velocity fragment reducing material such as UHMWPE or para-aramaid materials. The UHMWPE may have soft or hard formulations. Together the cushioning layer and the high velocity fragment reducing laminated layer operate as an insole. Beneath the fragment reducing layer 103, that is, away from the soldier's foot, the core 105 has a cell structure of single density foam or alternatively dual density foam depending upon the specific application, particularly impact attenuation, preferably EPP or alternatively EPE. The foam in the invention's core 105 of the sole has a density in the range of about 20 g/I to about 200 g/I, and specific cell structure, recovery rate, and stiffness that dissipate the energy of an impact upon the V like shape. The core may also utilize silicone gel packs in an alternate embodiment. Generally the core is positioned within the V shaped cross section of the sole, that is, interiorly of the sole. The V shape 104 of the sole 101, and the exterior of the foam 102 and fragment reducing layer 103 include a coating as later shown in FIG. 5. Alternatively, the coating extends upon the V shape 104 of the sole, the exterior of fragment reducing layer 103, the exterior of foam 102, and over the foam to surround the sole 101.

The core, generally of foam as at 105, has the construction of EPP with select properties well suited for this invention. The Applicant has tested various formulations of EPP in pursuit of a proper strain rate and density for blast and impact resistance. Devices that seek to attenuate blast and impact forces undergo testing according to certain military testing, not described here. Such testing has similarities to ASTM F1292, Standard Specification for Impact Attenuation of Surfacing Materials within the Use Zone of Playground Equipment. This Standard determines whether a material attenuates impact forces. A material that meets the Standard has these properties: a Gmax less than 200, a HIC less than 1000, densities from about 1.9 to about 3.7 pcf, strain rates between about 0.1 to about 0.4 MPa. At these densities, the EPP material works well for applications in temperatures from about −22° F. to about 212° F. as blast mitigating material. For applications at colder temperatures, EPE has a density between about 2.3 to about 4.2 pcf, strain rates between about 0.1 to about 0.4 MPa, and an operating temperature range of about −76° F. to about 160° F. The coating, preferably a select polyurethane, increased the operating temperature range an additional 20° F. to about 180° F. The EPP of the invention's core also meets military specifications.

Though a core of closed cell foam is shown and described above, the Applicant also foresees a hollow core with corresponding increase in thickness to the V shaped of the sole, as at 104. The hollow core also maintains the blast to sole angle of about 20° to about 60° as at ϕ and with a preference of 45°.

Figure 4:
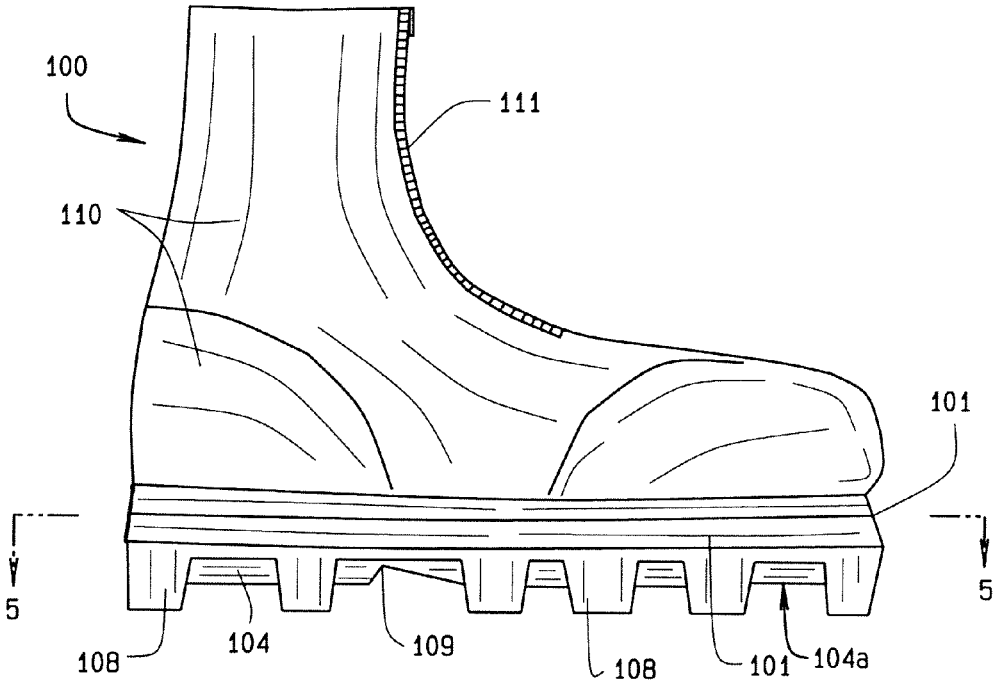
FIG. 4 illustrates a side view of the invention.

FIG. 4 then shows a side view of the invention as a boot with a ballistic upper 110 attached to the sole 101 and closed by laces as at 111. The upper is preferably leather lined with soft UHMWPE. Alternatively, the upper may be of ballistic fabric, UHWMPE, or thicker leather. The upper joins to the sole 101 with the cleats 108 opposite the upper. The sole has an elongated shape that fits beneath the upper and has a typical footprint like shape. Opposite the upper, the sole has a plurality of cleats 108 depending therefrom. The cleats have a spacing and arrangement suitable for traction on a variety of terrain. Inwardly from the cleats, the sole has its V like shape as at 104 extending for the length of the sole except through a flexure zone 109 here shown forward of the soldier's heel. The flexure zone generally lacks a portion of the keel 104*a* that extends beneath the heel and forefoot of a solder. Wearing the boot 100 as shown in FIG. 4, the soldier has reduced leg motion, reduced energy transmission, and reduced injuries to the foot, ankle, fibula and tibia. The present invention's V like shape as at 104 places a portion of the sole at an angle to the walking surface of the soldier of about 20° to about 60° as previously shown at ϕ, preferably 45°. With this angle of the sole, any blast energy radiates away from the soldier's foot.

Figure 5:
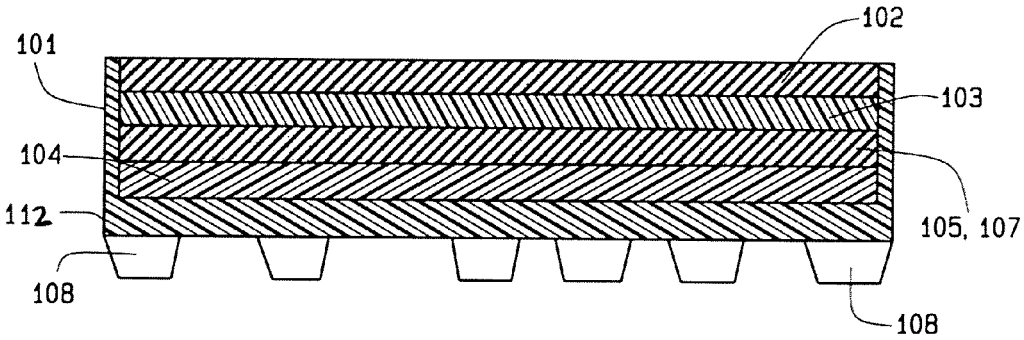
FIG. 5 sectional view through the sole of the invention.

FIG. 5 shows a sectional view of the invention with its layers and components that form the sole 101. This view sections the sole 101 lengthwise so the V like shape appears as a rectangle denoted as 104. From the soldier's foot outwardly, the sole begins with the layer 102 of energy absorbing foam here shown towards the top of the figures, that is, above the cleats 108 and opposite the vertex 104*b*. Below the foam layer 102, the sole has the high velocity fragment reducing layer 103 or insole. The foam layer 102 and the insole 103 extend for the length of the boot. Beneath the fragment reducing layer 103, the sole has its core 105 shown as a rectangle because of the lengthwise section. The core is typically closed cell foam. An alternate form of the core utilizes silicone gel packs, 107, to fill the core. Beneath the core, the sole has a section of the V like shape 104, here though shown as a rectangle. Depending on the location of the section through the sole, the apparent thickness of the core 105 expands and contracts and the section of the V like shape lowers and raises in the drawing. The layers 102 and 103, the V like shaped sole as at 104, and the core 105, each have a perimeter defined as the outermost portion and located proximate the outer portions of the bottom of the upper when the boot 100 is assembled.

Beneath the section of V like shape, the sole has a urethane coating 112 or outsole. The urethane coating includes the cleats 108, covers the V like shape of the sole as at 104, and then extends upwardly upon the perimeter of the core 105 and the layers 102 and 103. From the exterior of the boot 100, a soldier would see the urethane coating. In an alternate embodiment, the coating extends over the cushioning layer 102 and completely encases the sole. The coating elongates proportionally to the core and the sole.

The present invention assembles the foam layer 102 upon the fragment reducing layer 103 which covers the core 105 within the V shaped sole as at 104 and places the assembled layers, core, and sole in a mold filled with the composition of the coating 112 as later described. The next step of manufacturing applies heat and pressure to the mold and the assembled layers, core, and sole with coating in the mold. The Applicant utilizes a mold temperature from about 185° F. to about 225° F. and pressurization of the mold from about 1850 psi to about 4300 psi to form the invention, particularly its sole 101. The temperature and pressure of the mold transfer to the assembled layers, core, and sole, and the coating resulting in unitary sole that includes the V shape merged with the core and layers 102 and 103. In an alternate embodiment, the energy absorbing layer 102 is merged to the high velocity fragment reducing layer 103 to form a unitary insole utilizes a mold temperature from about 185° F. to about 225° F. and pressurization of the mold from about 1850 psi to about 4300 psi during a compression molding process.

The coating 112 includes from about six to about nine components that allow a mechanical bond of the coating to the substrate of the V like sole as at 104 and the perimeters of the core 105 and the layers 102 and 103 following skiving. The coating has the following properties: less than 3% shrinkage, tensile strength in excess of 2000 psi, an elongation of 300%, a high coefficient of friction from about 0.7 to about 1.3, a shore hardness in excess of 75A, an operating temperature range of about −40° F. to about 210° F., and a lack of support for biological activity. The coating has a burn rating of 0.0" following FAA testing of approximately 1600° F. for approximately 15 seconds. The coating prevents warping of the sole and its elongation allows the coating and the substrate to attenuate impact forces during usage. The coating also permits inclusion of other components such as tinting agents, matting agents, traction additives, such as sand, vinyl flatteners, and fibers for cut resistance, particularly para-aramid synthetic fiber, such as poly-paraphenylene terephthalamide or Kevlar®, and additives that impart resistance to ultraviolet light. The traction additive, or agent, imparts to the coating a coefficient of friction from about 0.7 to about 1.30 that reduces or lessens impact injuries by reducing the probability of slips and falls upon the invention when installed. These other additives impart durability and slip resistance to a piece for various applications.

Preferably, the coating includes Scorpion X02-ZBG Biocidal Polyurethane made by Custom Concept Coatings of Belleville, Ontario, Canada. This polyurethane coating has three components: part A, part B, and part C. Part A has 1,1'-methylenebis (4-isocyanatocyclohexane), or $C_{15}H_{22}N_2O_2$, from Tokyo Chemical Industrial, Ltd. of Japan, and 2-n-Octyl-4-isothianzolin-3-one, or $C_{11}H_{19}NOS$, from Dalian Haoyuan Jinghua Science & Tech. Development Co., Ltd. of Yantai, China. Part B has proprietary miscellaneous zinc compounds and n-butyl acetate, or $C_6H_{12}O_2$, from Celanese Corp. of Oberhausen, Hoechst, Germany. Part C provides a catalyst containing at least one acrylic polymer, at least one residual monomer, and water. The preferred embodiment has these components mixed in ratios suitable to achieve the intended goals. The mixture has generally about 2 to about 3 parts A, about 0.5 to about 1.5 parts B, about 0.5 to about 1.5 parts C. For coloration and traction, the mixture includes about ⅛ to about ⅙ parts tint and about 1 part traction additive. The preferred embodiment of the coating for the invention has the exact proportions of 2.5 parts A, 1 part B, 1 part C, ⅐ parts tint, and 1 part traction additive. Preferably, the formulation of the invention follows these steps: blending part B into to part A, then adding part C to the blend of part B and part A, and then adding various additives as desired into the blend of part C into part B and part A. The preceding general and precise, preferred and alternate, mixtures undergo mechanical mixing for about 1.5 minutes to about 3.5 minutes, preferably 3 minutes. The mixing preferably occurs from about 55° F. to about 100° F. at a relative humidity of 5 percentage points less than the air temperature. The mixtures may be applied as a coating upon the EPP core using a high volume, low pressure, or HVLP, spray gun, brush, roller, or trowel within 20 minutes.

As desired by the end user, the coating attains a gloss finish without any flattener, a semi-gloss finish with 0.5 parts flattener, and a matte finish with 1 part flattener. For enhanced durability, the mixture of the urethane includes 1 part Kevlar fibers. Alternatively, construction of the invention may laminate Kevlar fabric upon the surface of the EPP core and integral with the coating.

The preceding description and figures often referred to a soldier. The references to a soldier and his role serve as examples because the invention installs can be worn by other persons. Such persons include without limitation Marines, sailors, airmen, coast guardsmen, miners, quarrymen, government workers dispatched to a hazardous area or a combat zone, deminers, and like persons and in roles that may encounter mines in known or unknown locations.

The boots of the invention may be cut, sewn, and molded in various sizes to fit the intended application. The boots of the invention also have single piece construction or be assembled in multiple sections. The layers and foam reference in this invention includes adjusting their thicknesses and angles to provide the proper level of protection in higher risk areas, that is, areas of a foot more exposed to blast effects, primarily the sole.

From the aforementioned description, a blast mitigating boot has been described. The blast mitigating boot is uniquely capable of deflecting blast and impact forces away from a soldier's foot so as to reduce or even prevent injuries to the lower legs of soldiers. The blast mitigating boot and its various components may be manufactured from many materials, including but not limited to, EPP, EPE, polymers, polyvinyl chloride, high density polyethylene, polypropylene, closed cell foam, open cell foam, nylon, leather, select metals, their alloys, and composites.

Various aspects of the illustrative embodiments have been described using terms commonly employed by those skilled in the art to convey the substance of their work to others skilled in the art. However, it will be apparent to those skilled in the art that the present invention may be practiced with only some of the described aspects. The invention has been described in terms of an illustrative embodiment. As those skilled in the art will appreciate, various changes and modifications may be made to the embodiments as shown without departing from the spirit or scope of the invention. It is not intended that the invention be limited by the specific embodiment shown. For purposes of explanation, specific numbers, materials and configurations have been set forth in order to provide a thorough understanding of the illustrative embodiments. However, it will be apparent to one skilled in the art that the present invention may be practiced without the specific details. In other instances, well known features are omitted or simplified in order not to obscure the illustrative embodiments.

Various operations have been described as multiple discrete operations, in a manner that is most helpful in understanding the present invention, however, the order of description should not be construed as to imply that these operations are necessarily order dependent. In particular, these operations need not be performed in the order of presentation.

Moreover, in the specification and the following claims, the terms "first," "second," "third" and the like -when they appear- are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to allow the reader to ascertain the nature of the technical disclosure. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description, with each claim standing on its own as a separate embodiment. The scope of the invention should be determined with reference to the appended claims, along with the full scope of equivalents to which such claims are entitled.

As such, those skilled in the art will appreciate that the conception, upon which this disclosure is based, may readily be utilized as a basis for the designing of other structures, methods and systems for carrying out the several purposes of the present invention. Therefore, the claims include such equivalent constructions insofar as they do not depart from the spirit and the scope of the present invention.

I claim:

1. A device to reduce lower leg injuries of people wearing the device, the device having an upper, the device comprising:

an energy absorbing core having a V like shape, said core being elongated and prismatic;

a sole outwardly of said core, said sole having a vertex, a keel including said vertex and extending for at least a portion of said sole, an insole of a high velocity fragment reducing layer upon said core spaced away from said keel and said vertex and a cushioning layer outwardly from said high velocity fragment reducing layer and opposite said vertex, a plurality of cleats upon said sole outwardly from said high velocity fragment reducing layer, said cleats extending downwardly beyond said keel;

said vertex having an internal angle $\phi$ being 45°;

a coating upon said sole including said keel, and said coating elongating proportionally to said sole and said core;

said coating including about 2 to about 3 parts Part A; about 0.5 to about 1.5 parts Part B; about 0.5 to about 1.5 parts Part C;

wherein Part A is 1,1'-methylenebis (4-isocyanatocyclohexane) and 2-n-Octyl-4-isothianzolin-3-one; wherein Part B is at least one zinc compound and n-butyl acetate; wherein Part C is a catalyst, said catalyst including one of at least one acrylic polymer, at least one residual monomer, and water;

said core being one of expanded polypropylene and expanded polyethylene;

said cushioning layer being one of expanded polypropylene and expanded polyethylene;

said high velocity fragment reducing layer being one of ultra high molecular weight polyethylene and para-aramid;

said coating having traction additive; and, said sole having a flexure zone interrupting said keel and said core wherein said flexure zone bends said sole during usage.

* * * * *